US010272696B2

(12) United States Patent
Llorach To et al.

(10) Patent No.: US 10,272,696 B2
(45) Date of Patent: Apr. 30, 2019

(54) PRINTED MEDIA DRYER

(71) Applicant: Hewlett-Packard Development Company, L.P., Houston, TX (US)

(72) Inventors: Marcel Llorach To, Sant Cugat del Valles (ES); Alberto Arredondo, Sant Cugat del Valles (ES); Alberto Borrego Lebrato, Sant Cugat del Valles (ES); Eduardo Martin Orue, Sant Cugat del Valles (ES)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 15/748,564

(22) PCT Filed: Oct. 30, 2015

(86) PCT No.: PCT/EP2015/075263

§ 371 (c)(1),
(2) Date: Jan. 29, 2018

(87) PCT Pub. No.: WO2017/071773

PCT Pub. Date: May 4, 2017

(65) Prior Publication Data

US 2018/0222214 A1 Aug. 9, 2018

(51) Int. Cl.

| | |
|---|---|
| ***F26B 3/04*** | (2006.01) |
| ***F26B 13/10*** | (2006.01) |
| ***F26B 13/00*** | (2006.01) |
| ***F26B 21/04*** | (2006.01) |
| ***B41J 11/00*** | (2006.01) |
| ***F26B 21/12*** | (2006.01) |

(52) U.S. Cl.
CPC ..... *B41J 11/002* (2013.01); *F26B 3/04* (2013.01); *F26B 13/00* (2013.01); *F26B 13/108* (2013.01); *F26B 21/04* (2013.01); *F26B 21/12* (2013.01)

(58) Field of Classification Search
CPC ... B41J 11/002; F26B 3/04; F26B 3/14; F26B 13/00; F26B 13/108; F26B 21/024; F26B 21/04; F26B 21/12
See application file for complete search history.

(56) References Cited

U.S. PATENT DOCUMENTS

| | | | | |
|---|---|---|---|---|
| 3,012,335 A | | 12/1961 | Claes et al. | |
| 3,324,570 A | | 6/1967 | Donald et al. | |
| 5,016,363 A | | 5/1991 | Krieger | |
| 5,023,654 A | * | 6/1991 | Matsumoto | G03B 27/32 355/106 |
| 5,126,781 A | * | 6/1992 | Tomizawa | G03F 7/0032 355/30 |

(Continued)

FOREIGN PATENT DOCUMENTS

| | | |
|---|---|---|
| JP | 2009045861 | 3/2009 |
| JP | 2010274525 | 12/2010 |

*Primary Examiner* — Anh T Vo
(74) *Attorney, Agent, or Firm* — HP Inc. Patent Department

(57) ABSTRACT

An apparatus comprises a dryer to force air onto a printed media during use to dry the printed media, and an air collector comprising at least one suction opening throughout which, in use, air from the dryer is collected. The apparatus may guide the collected air back to the dryer. The at least one suction opening may be arranged so as to stop the printed media from rising due to pressure differential.

8 Claims, 4 Drawing Sheets

(56) References Cited

U.S. PATENT DOCUMENTS

| | | | | |
|---|---|---|---|---|
| 6,439,712 | B1 * | 8/2002 | Mizutani | B41J 2/01 219/216 |
| 6,484,418 | B1 | 11/2002 | Hada et al. | |
| 8,434,849 | B2 | 5/2013 | Kurasawa et al. | |
| 8,955,956 | B2 | 2/2015 | Yamamoto et al. | |
| 2011/0199448 | A1 * | 8/2011 | Kaiho | B41J 11/002 347/102 |
| 2013/0194367 | A1 | 8/2013 | Chiwata et al. | |

* cited by examiner

PRINTED MEDIA DRYER

BACKGROUND

When drying printed media, such as ink on paper, dryers that impinge hot air at high speed are sometimes used. The impact of the hot air against the printed media is that it accelerates evaporation of ink on the printed media. These types of dryers may be used, for example, in printers.

BRIEF DESCRIPTION OF THE DRAWINGS

Examples will now be described, by way of non-limiting example, with reference to the accompanying drawings.

DETAILED DESCRIPTION

Figure 1:
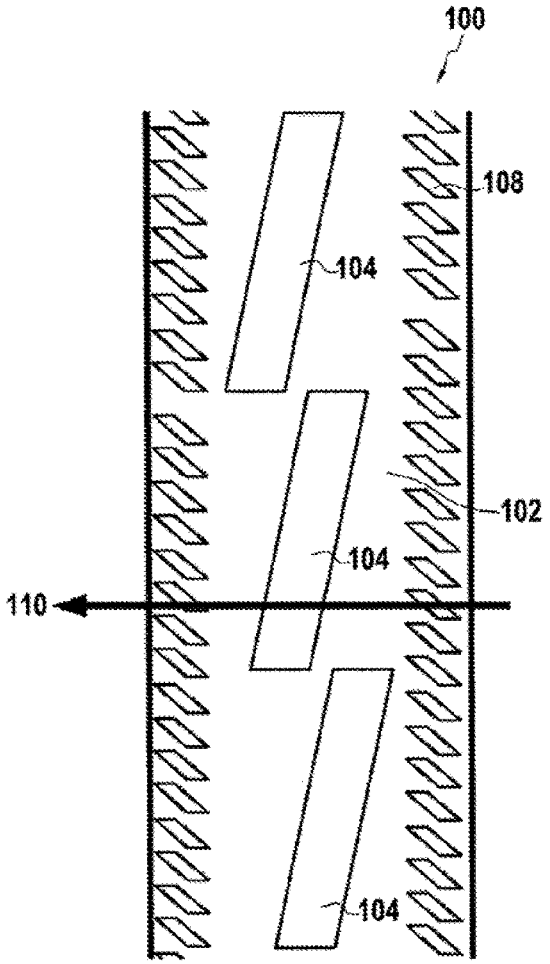
FIG. 1 and FIG. 2 show an example of a dryer.

The following detailed description refers to the accompanying drawings. Wherever possible, the same reference numbers are used in the drawings and the following description to refer to the same or similar parts. While several examples are described in this document, modifications, adaptations, and other implementations are possible. Accordingly, the following detailed description does not limit the disclosed examples. Instead, the proper scope of the disclosed examples may be defined by the appended claims.

To dry recently printed print media, some apparatuses use dryers that dry by impinging hot air at high speed on to the printed media. In some implementations, the combination of fast moving air and heat can increase the speed with which an agent applied to a print media will dry, set, cure, or otherwise become fixed to the print media. In some examples, the media may be a lamina material or two dimensional sheet. For example, the media may be paper, webbing, fabric, plastic sheeting or any other media suitable for printing. In some examples the media may be printed by applying an agent to the media, for example, ink, dye or an adhesive such as glue. The combination of agent on media is referred to herein as printed media.

As schematic of an example dryer is illustrated in FIG. 1 which shows a dryer 100 comprising a first surface 102 comprising at least one opening 104 through which air is forced during use to dry a printed media (not shown). The dryer may also contain recirculation holes 108. During use, printed media may be passed under the dryer 100 in a traveling direction such as the direction indicated by the arrow 110.

When the example dryer 100 of FIG. 1 is in use, a low pressure region may form below the openings 104 (e.g., above the printed surface of the printed media).

Figure 2:
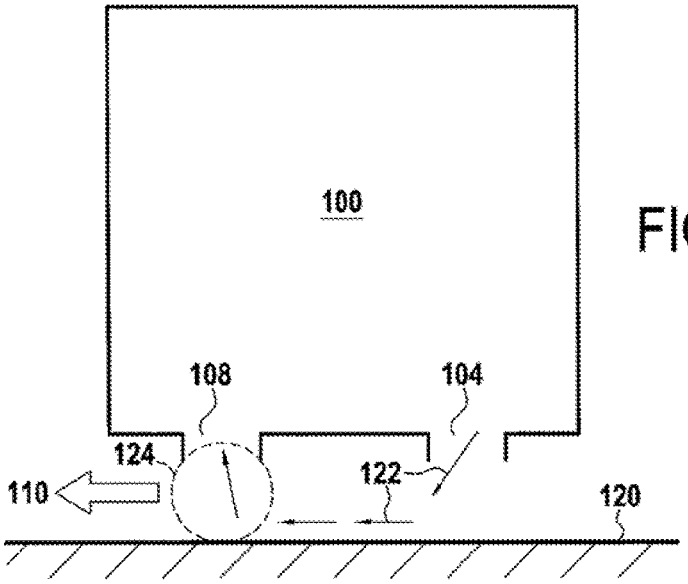

FIG. 2 shows an example of the dryer 100 which forces hot air 122 through an opening 104 onto printed media 120. The flow of hot air 122 can aid in drying the printed media 120. To prevent unwanted air circulation effects, the hot air 122 can be exhausted from the region between the dryer 100 and the printed media 120 through recirculation hole 108. However, in some scenarios, exhausting the at hot air 122 through the recirculation hole 108 may produce negative pressure gradients in negative pressure region 124 between opening 108 and the surface of the printed media 120. The negative pressure region 124 can result in a pressure differential between the top and bottom surface of the printed media that may cause it to lift up. Lifting of the printed media 120 can be particularly problematic when the edges of the printed media 120 lift up and cause mechanical interference with its progression along direction 110.

In addition, when a printed media 120 is lifted due to pressure differential, the surface of the printed media may come in contact with various parts of the dryer 100 that may cause ink transfer or smudges, thus degrading the quality of printing. For example, ink transfer or smudging may be particularly problematic at the leading and trailing edges of the printed media.

Another possible effect of the negative pressure region 124 can include the leading edge of the printed media 120 rising up towards or into the openings 108. If the leading edge is not restrained (for example by a pinch mechanism that holds the printed media 120 in place before it enters the dryer), the printed media 120 can jam. In some implementations, it is desirable to use a dryer that does not include a mechanism for restraining the printed media 120.

The negative pressure region 124 can be the result of hot air 122 flowing away from the surface of the printed media 120 to flow through the recirculation hole 108. Suppressing flow of the hot air 122 through would inhibit collection of the hot air 122 for recirculation into the dryer 100.

To stop the printed media 120 from rising, it may be possible to reduce the speed of the airflow of the hot air 122 produced by the dryer, at least while the leading and trailing edges of the printed media 120 are in the negative pressure region 124 under the recirculation hole 108. However, to ensure proper drying of the printed media 120 during these periods, the traveling speed of the printed media 120 can be slowed down accordingly. Because slowing the speed at which the printed media 120 travels affects the print speed of the printer in which the dryer 100 is included, such techniques are not ideal for high speed printing systems.

As described herein, some mechanisms may be included in a printer to prevent media lifting from occurring but such mechanisms may not always be desirable when complexity or compactness of a printer is a concern.

To address the above issues, and more generally to improve drying of a printed media 120, a technique is proposed herein which modifies the configuration of the recirculation hole of the dryer.

It has been found that media lifting occurs mainly because recirculation holes in some dryers are too concentrated above the path of the printed media 120, this resulting in a high negative pressure being induced in local regions of the printed media 120. To prevent media lifting, some examples set out herein includes a collector to collect the air forced by a dryer on a printed media 120, wherein the suction openings of the collector through which air is collected are spread along the printed media 120 path so as to prevent media lifting.

By spreading the suction openings above the path of the printed media 120, it is possible to more evenly distribute the regions where negative pressure may occur due to upward airflow towards the suction openings. Some negative pressure gradients may still occur on the front surface of the printed media 120 but in a lesser degree in each point of the printed media 120.

The present disclosure also proposes arranging suction openings with a sufficiently high total area to prevent occurrence of media lifting.

The present disclosure also proposes a new arrangement of a dryer which allows more flexibility for arranging suction openings above the path of the printed media 120.

Figure 3:
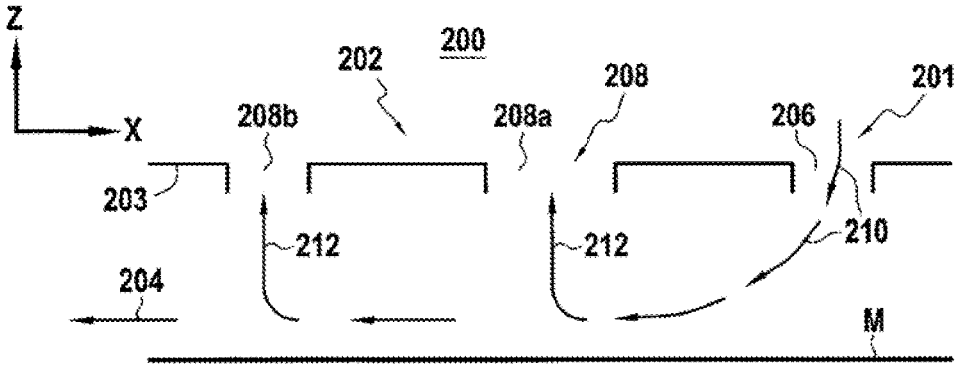
FIG. 3 shows an apparatus according to an example of the present disclosure.

FIG. 3 shows an example apparatus 200 comprising a dryer 201 and a collector 202. When in use, the dryer 201 may force air 210 onto a printed media M to dry said printed media. To this end, dryer 201 may comprises an opening 206 through which air 210 is blown by the dryer 201. The opening 206 is disposed on a surface 203 positioned above the traveling path of a printed media M such that, when the printed media M is conveyed along this path in a traveling direction 204, the air 210 impinges on the front surface of the printed media M so as to dry the front surface thereof. The air 210 may be heated air to accelerate drying of the printed media M.

The dryer 201 may for instance include a heater and a fan (not shown). The heater may raise the temperature of the air and produce hot air. The fan may blow the hot air on the printed media M.

In use, the printed media M may be fed past (i.e. underneath) the dryer 201 and the collector 202 in the traveling direction 204. The blown air 210 may circulate on the front surface of the printed media M and be collected by the air collector 202.

The air collector 202 comprises suction holes 208*a* and 208*b* (referred to collectively as 208) disposed on the surface 203 of the apparatus 202. It is noted that the use of two suction openings 208 in FIG. 3 is merely an example and in other examples, there may be a single suction opening 208 and more than two suction openings.

During use, the air collector 202 may collect air 210 from the dryer 201 through the suction openings 208. The airflow (noted 212) is collected by the suction openings 208 predominantly in an upward direction (along z axis) relative to the traveling direction 204 of the printed media M. It should be noted that the entire airflow 212 may not always travels strictly vertically through the suction openings 208. The average velocity vector of the airflow 212 has however at least a component in the upward direction relative to the printed media M.

The air collector 202 may guide the collected air 212 back to the dryer 201 for recirculation. The air collector 202 allows collected air 212 to be reused by the dryer 201 for drying purposes, thereby improving the drying efficiency of the apparatus.

Figure 4:
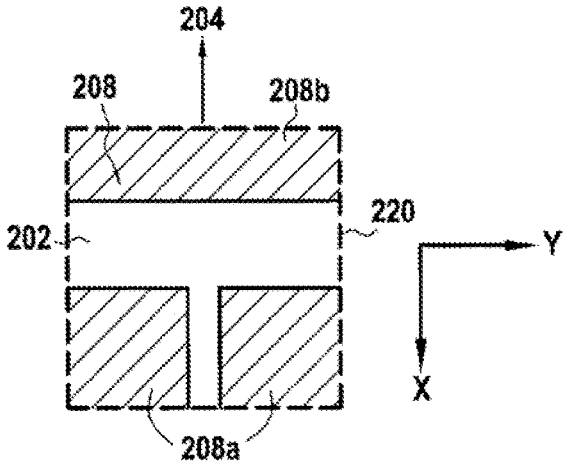
FIG. 4 and FIG. 5 show example arrangements of suction openings.

FIG. 4 shows an example where three suction openings 208 are arranged above the traveling path of the printed media M to collect air from the dryer 201. In this example, two suction openings 208*a* are arranged in a row (along x axis) perpendicular to the traveling direction 204. Additionally, an elongated suction opening 208*b* is arranged above the traveling path apart from the suction openings 208*a* along the traveling direction.

Various shapes, dimensions and positions of the suction openings 208 may be contemplated in the present disclosure to prevent media lifting.

In a particular example, the collector 202 comprises at least two suction openings 208 which are distributed along the traveling direction 204 to achieve optimal recollection of the upward airflow 212 from the dryer 201 while limiting occurrence of media lifting.

Figure 5:
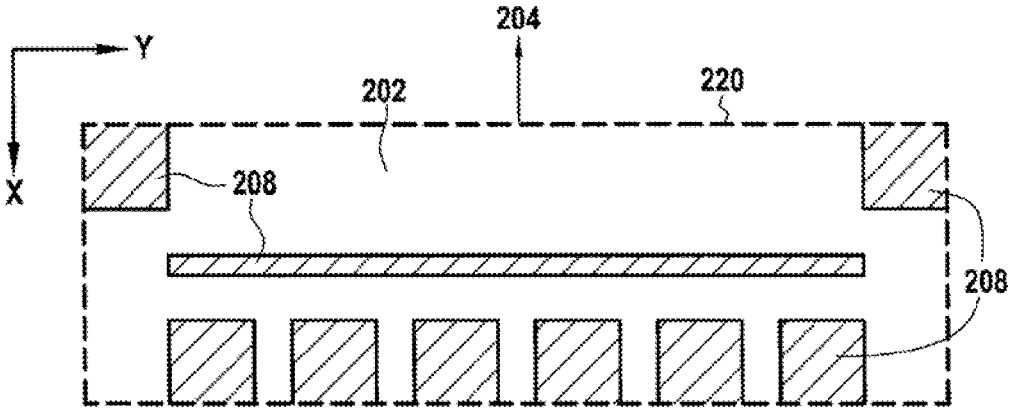

FIG. 5 shows another example where multiple suction openings 208 are arranged above the traveling path of the printed media M. The suction openings 208 are distributed along the x and y axes so as to cause a more uniformed negative pressure region above the printed media. Limited negative pressure is thus applied in each point of the printed media M.

In some examples, the suction openings may be arranged such that:

$$A/T \leq 1/5 \quad (1)$$

where A is the total area of the suction openings 208 and T is the area of the minimum rectangle of reference 220 that comprises each suction opening 208.

In other terms, the at least one suction opening 208 may be arranged such that the total area A of the at least one suction opening 208 is less than or equal to one fifth the area T of the minimum rectangle of reference 220 that comprises each suction opening 208.

By meeting this condition (1), it can be ensured that the suction openings 208 are sufficiently spread above the traveling path of the printed media M so as to avoid media lifting.

The minimum rectangle of reference, as mentioned above, is a rectangular area of reference which, in this example, is used to define a maximum acceptable concentration of the suction openings 208 on surface 203 of apparatus 200.

FIGS. 4 and 5 show the minimum rectangle of reference 220 which, in each example, includes all the suction openings 208 of collector 202.

In a particular example, the suction openings 208 may be spread above the traveling path of the printed media M such that, in use, no more than 0.4 Pa of average negative pressure is applied on average on the portion of the printed media M positioned in correspondence with the minimum rectangle of reference 220 (i.e. the portion of the printed media M positioned underneath the total area of the minimum rectangle of reference 220 as defined above). By having less concentrated suction openings 208 disposed above the printed media M, media lifting may be reduced or prevented. The value of −0.4 Pa has been found to be the threshold that should not be exceeded beneath the total area of the minimum rectangle of reference 220 to prevent media lifting.

In some examples, the apparatus 200 described above may be fully integrated in a printer. As such, in some examples, the surface 203 may form part of a larger surface or a larger component part that comprises additional components for printing. In other examples, the apparatus 200 may be a separate component that is attached to, or forms part of a print apparatus.

The dryer 201 and the collector 202 may be formed as a single unitary body. In another example, the collector 202 is a component assembled with the dryer 201.

In some examples, in use, the dryer 201 forces the air 206 at a mass $\dot{m}$. The suction openings may be arranged such that:

$$\dot{m}/A \leq 0.2 kg \cdot m^{-2} \cdot s^{-1} \quad (2)$$

Arranging sufficiently wide suction openings 208 (i.e. a sufficiently high total area of the suction openings 208) for a given mass flow $\dot{m}$ allows limiting the negative pressure P that may occur beneath the suction openings 208, as can be understood from the following equation:

$$d \cdot P \cdot A = -\dot{m} \cdot v \quad (3)$$

where v is the flow velocity of the airflow 212 collected by a suction opening 208, $\dot{m}$ is the mass flow of the collected air, d is the density of air, and A is the total area of all the suction openings 208 considered together.

Figure 6:
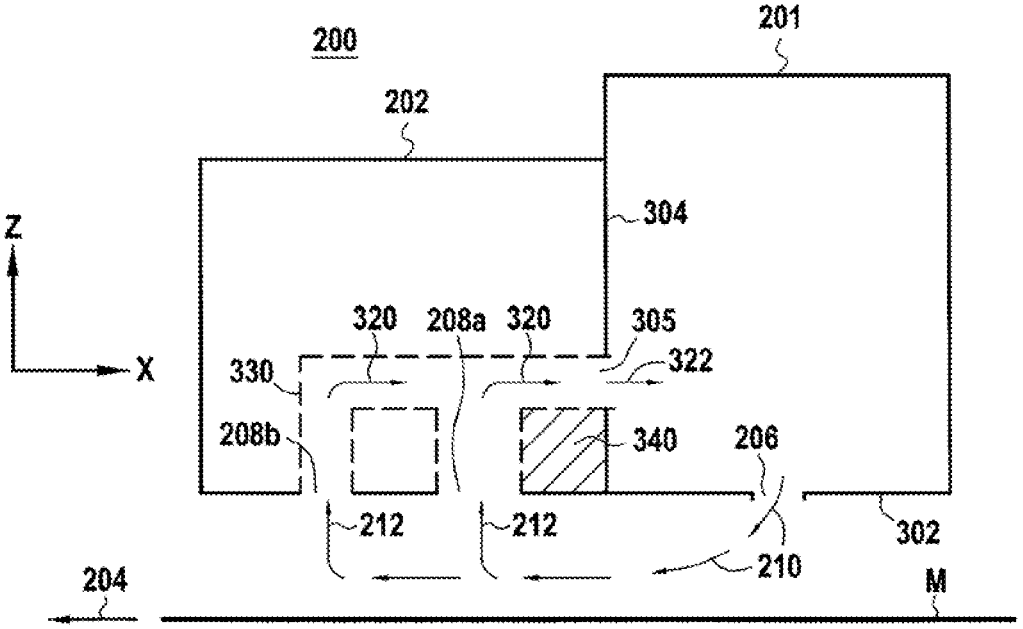
FIG. 6 shows an apparatus according to an example of the present disclosure.

FIG. 6 shows an example of arrangement of the apparatus 200 described above. In this particular example, dryer 201 and collector 202 are two separate components which are assembled with each other. In use, apparatus 200 dries a printed media M which is fed underneath said apparatus 200 in the traveling direction 204.

In the example of FIG. 6, it is assumed that apparatus 200 is part of a printer, although other embodiments of the present disclosure may be contemplated.

The collector 202 may be for instance a media output pinch roller assembly which, in use, urges the printed media M forward along the traveling direction 204.

The dryer 201 includes a first opening 206 through which air 210 is forced onto the printed media M during use to dry said printed media M. This first opening is arranged on a bottom face 302 of the dryer 201 above the travelling path of the printed media M. In this particular example, the dryer 201 also includes a recirculation hole 305 which, in use, receives air 212 collected by the collector 202. In this example, the recirculation hole 305 is positioned on a side wall 304 of the dryer 201 relative to the bottom face 302.

It should be noted that the use of a single recirculation hole 305 in FIG. 6 is merely an example. In other examples, at least two recirculation holes 305 may be used to supply the dryer 201 with the collected air 212.

Arranging the recirculation hole 305 on a side wall 304 of the dryer 201 allows more flexibility in the arrangement of the suction openings 208 above the traveling path of the printed media M. In many cases, the structure of the dryer 201 (for example in a printer) is of limited size and it is not always possible to arrange suction openings in an optimal pattern to collect air for recirculation. Positioning the recirculation hole 305 on the side wall 304 allows suction openings 208 to be arranged outside the dryer 201 where more space and freedom can be found to position the suction holes 208 in an optimal manner. This allows for instance spreading the suction openings 208 along the traveling path of the printed media M to prevent occurrence of media lifting.

In the example of FIG. 6, the collector 202 includes suction openings 208*a* and 208*b* as already described with reference to FIG. 3, although other arrangements of suction openings 208 may be contemplated, such as the arrangement illustrated in FIG. 5 for instance. Collector 202 may, in use, collect through the suction openings 208*a*, 208*b* the airflow 212 coming from dryer 201 in an upward direction (along z axis) relative to the traveling path of the printed media M.

The collector 202 includes a guide 330 which guides the collected air (noted 320) from the suction openings 208 back to the recirculation hole 305 of the dryer 201. This guide 330 may be formed of any structure (pipes, walls etc.) that is appropriate for conveying air form the suction openings 208 towards the dryer 201.

In some examples, it has also been found that optimal recirculation performances may be achieved when the suction openings 208 are arranged such that the collected air 320 cannot reach in an upward direction the recirculation hole 305 positioned on a side wall 304 of the dryer 201. In the example configuration of FIG. 7B, for instance, the airflow 320 is traveling at high speed in an upward direction towards the recirculation hole 305. As a result, less airflow than desired may be collected by suction openings 208*a* and 208*b* positioned further away from the first opening 206.

Figure 7A:
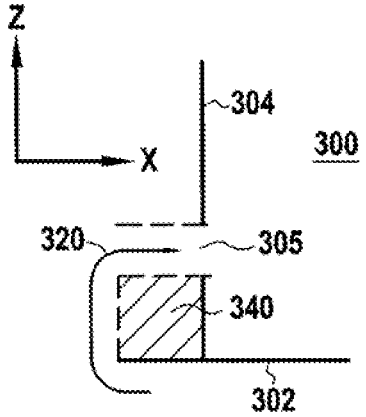
FIGS. 7A and 7B show example arrangements of an apparatus.
Figure 7B:
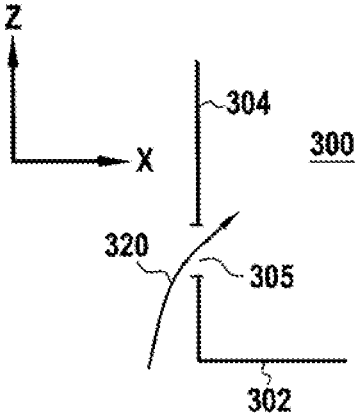

Accordingly, as shown more specifically in FIG. 7A, the apparatus 200 may in some examples include an air deflector 340 to prevent air from the first opening 206 to reach the recirculation hole 305 in an upward direction relative to the traveling path. This deflector (or guiding structure) may be of any structure, shape, dimensions etc. suitable for preventing direct access to the recirculation hole 305 by an upward airflow collected by the apparatus 200.

In some examples, the deflector 340 may be formed such that the average velocity of the collected airflow 320 reaching the recirculation hole 305 does not have a component in the upward direction relative to the printed media M. In some examples, the deflector 340 may guide the airflow 320 into the recirculation hole 305 downwards (or substantially downwards) relative the printed media M.

In a particular example, the collector 202 is a media output pinch roller assembly which, in use, urges the printed media M forward along the traveling direction 204. The assembly 202 may include pinches beam, wherein holes are arranged in these pinches beam to allow passage of the collected air 320 within the guide 330 towards the dryer 201.

Figure 8:
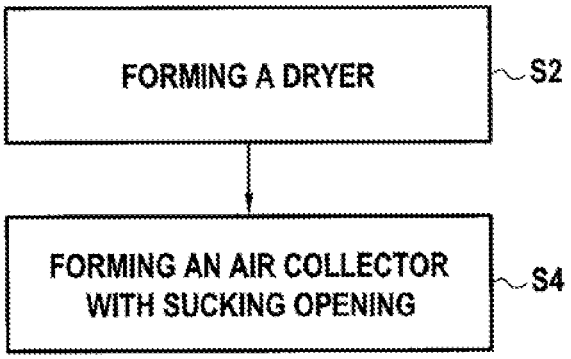
FIG. 8 is a flowchart of an example of a method for manufacturing an apparatus.

According to another example shown in FIG. 8, there is provided a method of manufacturing an apparatus including a dryer and a collector. The method includes forming (S2) a dryer 201 to force air 210 onto a printed media M during use to dry the printed media M, and forming (S4) an air collector 202 with a suction opening 208, wherein the collector is formed so as to be able, in use, to guide the collected air back to the dryer. The method of FIG. 8 may be carried out to manufacture an apparatus 200 according to one of the examples described above.

In a particular example, the method of FIG. 8 includes forming an air collector 202 comprising at least one suction opening 208 throughout which, in use, air from the dryer 201 is collected in an upward direction relative to the traveling direction 204 of the printed media M, wherein said air collector is to guide the collected air back to said dryer 201.

In an example, the forming of the air collector 202 is such that the at least one suction opening 208 meets the condition (1), that is:

$$A/T \leq 1/5$$

wherein A is the total area of the at least one suction opening and T is the area of the minimum rectangle of reference comprising each suction opening, as already explained earlier.

In other terms, the at least one suction opening 208 may be formed such that the total area A of the at least one suction opening 208 is less than or equal to one fifth the area of the minimum rectangle of reference T that comprises each suction opening 208.

In a particular example, there is provided a method of manufacturing a printer into which media may be fed, during use, along a travelling path, the method including forming a first opening through which air is forced in use to dry the media; and forming second openings through which, in use, air from the first opening is received upwardly relative to the traveling path for recirculation into the first opening, wherein the second openings are spread above the travelling path such that, in use, no more than 0.4 Pa of average negative pressure is applied, on average, on the portion of the printed media M positioned in correspondence with the minimum rectangle of reference 220 (i.e. the portion of the printed media M positioned underneath the total area of the minimum rectangle of reference 220 as defined above).

In a particular example, there is provided a method of manufacturing a printer into which media may be fed, during use, along a travelling path, the method including forming a dryer including a first opening through which air is forced onto a printed media during use to dry the printed media, the first opening being arranged on a bottom face of the dryer above the travelling path, said dryer including a recirculation hole on a side wall relative to the bottom face; and forming an air collector comprising at least one suction opening throughout which, in use, air from the first opening is collected in an upward direction relative to the traveling path of the printed media, wherein said air collector is to guide the collected air back to the recirculation hole of the dryer.

Figure 9:
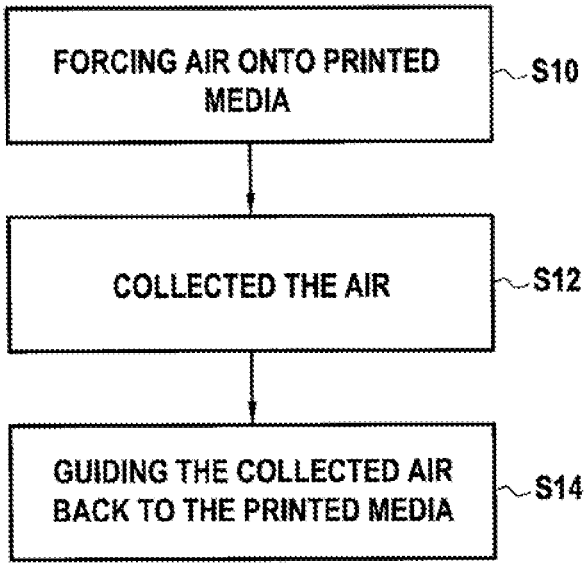
FIG. 9 is a flowchart of an example of a method for collecting air from a dryer.

According to another example shown in FIG. 9, there is provided a method of collecting air from a dryer 201. The method includes forcing (S10) air onto a printed media M to dry said printed media M; and collecting (S12) the forced air through at least one suction opening 208 in an upward direction relative to a traveling direction 204 of the printed media M.

In a particular example of the method, the at least one suction opening may be arranged such that is satisfies condition (1) defined previously, that is:

$$A/T \leq 1/5$$

wherein A is the total area of the at least one suction opening and T is the area of the minimum rectangle of reference comprising each suction opening, as already explained earlier.

The method of FIG. 9 may include guiding (S14) the collected air to be forced back onto the printed media M.

In a particular example, during collecting S14, no more than 0.4 Pa of average negative pressure is applied, on average, on the portion of the printed media M positioned in correspondence with the minimum rectangle of reference 220 (i.e. the portion of the printed media M positioned underneath the total area of the minimum rectangle of reference 220 as defined above).

While the method, apparatus and related aspects have been described with reference to certain examples, various modifications, changes, omissions, and substitutions can be made without departing from the scope of the present disclosure. It is intended, therefore, that the method, apparatus and related aspects be limited only by the scope of the following claims and their equivalents. It should be noted that the above-mentioned examples illustrate rather than limit what is described herein, and that alternative implementations may be designed without departing from the scope of the appended claims.

The word "comprising" does not exclude the presence of elements other than those listed in a claim, "a" or "an" does not exclude a plurality, and a single processor or other unit may fulfil the functions of several units recited in the claims.

The features of any dependent claim may be combined with the features of any of the independent claims or other dependent claims.

The invention claimed is:

1. An apparatus comprising:

a dryer to force air onto a printed media during use to dry said printed media, wherein the dryer comprises:

a recirculation hole through which the air that is collected by said collector is received, the recirculation hole being positioned on a side wall of the dryer relative to the traveling direction;

an air collector comprising at least one suction opening throughout, which in use, air from said dryer is collected in an upward direction relative to a traveling direction of said printed media, wherein said air collector is to guide the air that is collected back to said dryer; and an air deflector to prevent the air from a first opening of the dryer to reach the recirculation hole in an upward direction relative to the traveling direction, wherein the at least one suction opening is arranged such that a total area of the at least one suction opening is less than or equal to one fifth of an area of a minimum rectangle of reference that comprises each suction opening.

2. The apparatus according to claim 1, wherein the apparatus is integrated in a printer.

3. The apparatus according to claim 1, wherein the collector and the dryer are formed as a single unitary body.

4. The apparatus according to claim 1, wherein the collector is a component assembled with the dryer.

5. The apparatus according to claim 4, wherein the collector is a media output punch roller assembly to urge the printed media forward during use along said traveling direction.

6. The apparatus according to claim 1, wherein at least two suction openings are distributed along the traveling direction.

7. A printer, wherein a print media is fed, during use, into the printer along a travelling path, comprising:

a dryer comprising a first opening through which air is forced onto said printed media during use to dry said printed media, the first opening being arranged on a bottom face of the dryer above the travelling path, said dryer comprising a recirculation hole on a side wall relative to the bottom face;

an air collector comprising at least one suction opening throughout, which in use, the air from said first opening is collected in an upward direction relative to the traveling path of the printed media, wherein said air collector is to guide the air that is collected back to the recirculation hole of the dryer; and an air deflector to prevent the air from a first opening of the dryer to reach the recirculation hole in the upward direction relative to the traveling path.

8. A method comprising:

forming a dryer to force air onto a printed media during use to dry said printed media;

forming an air collector comprising at least one suction opening throughout, which in use, air from said dryer is collected in an upward direction relative to a traveling direction of the printed media, wherein said air collector is to guide the collected air back to said dryer; and forming an air deflector to prevent the air from a first opening of the dryer to reach the recirculation hole in an upward direction relative to the traveling direction, wherein the at least one suction opening is formed such that a total area of the at least one suction opening is less than or equal to one fifth of an area of a minimum rectangle of reference that comprises each suction opening.

* * * * *